US005916450A

United States Patent [19]

Muggli et al.

[11] Patent Number: 5,916,450

[45] Date of Patent: Jun. 29, 1999

[54] METHOD OF BALANCING A DISPLAY PANEL SUBSTRATE

[75] Inventors: Dale A. Muggli; Daniel P. Wilkie, both of Duvall; Steven A. Mills, Puyallop, all of Wash.

[73] Assignee: IDD Aerospace Corp., Redmond, Wash.

[21] Appl. No.: 08/938,924

[22] Filed: Sep. 26, 1997

[51] Int. Cl.[6] ..... B44C 1/22

[52] U.S. Cl. ..... 216/4; 216/65; 216/24

[58] Field of Search ..... 216/4, 24, 39, 216/56, 65

[56] References Cited

U.S. PATENT DOCUMENTS

| | | | |
|---|---|---|---|
| 4,188,095 | 2/1980 | Nishimura et al. | 216/4 X |
| 4,968,526 | 11/1990 | Takii et al. | 427/53.1 |
| 5,456,955 | 10/1995 | Muggli | 427/555 |
| 5,723,843 | 3/1998 | Muggli | 216/4 X |

*Primary Examiner*—William Powell

*Attorney, Agent, or Firm*—Heller Ehrman White & McAuliffe

[57] ABSTRACT

A method of balancing a display panel substrate for a backlit illuminated display includes providing a transparent display panel substrate having a front surface, a back surface, and side surfaces, the substrate being coated with a diffuse reflective layer and overcoated with an opaque layer on the back surface and side surfaces, and having recesses in the back surface to receive lamps to provide illumination to the display; coating the substrate on the front surface with a diffuse translucent layer of defined thickness; illuminating the substrate by lamps positioned within the recesses in the back surface of the substrate; forming an image indicative of the brightness at each point of the front surface of the illuminated substrate and determining from the image the additional thickness of diffuse translucent layer to be added to each point on the front surface of the substrate to produce a uniform brightness of a desired intensity at each point of the front surface when that layer is added and the substrate is illuminated; and adding to each point on the front surface of the substrate a diffuse translucent layer of a thickness determined for that point in accordance with the previous step.

10 Claims, 2 Drawing Sheets

METHOD OF BALANCING A DISPLAY PANEL SUBSTRATE

CROSS-REFERENCE TO RELATED APPLICATIONS

Not applicable.

STATEMENT REGARDING FEDERALLY SPONSORED RESEARCH

Not applicable.

REFERENCE TO MICROFICHE APPENDIX

Not applicable.

FIELD OF THE INVENTION

This invention relates to backlit illuminated displays, and specifically to a method for balancing display panel substrates for such displays.

BACKGROUND OF THE INVENTION

Backlit illuminated displays are a widely employed means for presenting visual information to a user where low ambient light conditions may be encountered, and are commonly used in such applications as automobile and aircraft instrument panels. These displays generally present visual information to a user in the form of light colored indicia (letters, words, symbols, etc.) on a dark background; and consist of a display panel bearing the indicia and one or more lamps or other light sources disposed behind or recessed into the back surface of the display panel. In high ambient light conditions, the indicia on the display panel are viewed by light reflected in the front surface of the display panel; however, in low ambient light conditions, light from the lamps behind or recessed into the back surface of the display panel projects through the indicia to provide illumination to the display panel, and the indicia are viewed by this transmitted light. In both high and low ambient light conditions, a high contrast between the indicia and their background (typically greater than about 9:1, as measured by MIL-P-7788F) is desirable; and since this contrast is provided by light transmitted through the indicia in low ambient light conditions, an appropriate brightness of the illuminated areas of the display (typically about 2–9 nit) is desirable.

A typical display panel is prepared from a transparent display panel substrate (a sheet of a transparent polymer, such as a cast acrylate) by:

(a) machining the substrate to the desired shape, and making cutouts in the substrate for switches, instruments, fasteners, and the like to be mounted through the panel;

(b) coating the back surface and side surfaces of the substrate first with a diffuse translucent layer, typically by spray painting of an extremely flat white paint of a thickness between about 15 and 50 microns, to reflect light leaking from the back surface of the substrate back into the substrate in a diffuse manner, then with an opaque layer, typically by spray painting of a flat black paint of a similar thickness, to block remaining light leakage from the substrate;

(c) drilling recesses in the back surface of the substrate for lamps to provide the illumination of the display;

(d) coating the front surface of the substrate with a diffuse translucent layer (also typically by spray painting of a flat paint); and (e) further coating the front surface of the substrate with an opaque layer (also normally by spray painting), and exposing the underlying translucent layer in a pattern defining the indicia desired in the display. This last step is typically accomplished by completely coating the front surface with the opaque layer, then etching or otherwise selectively removing that opaque layer to expose the translucent layer in the desired pattern.

U.S. Pat. No. 5,456,955 (Muggli) describes such a process, where the translucent layer on the front surface is overcoated with a clear layer before being further coated with the opaque layer, and the opaque layer is etched with a neodymium yttrium aluminum garnet (NdYAG) laser. The use of a clear layer is stated to simplify the use of the NdYAG laser to etch the opaque layer without potential damage to the underlying translucent layer. The disclosure of this patent is incorporated by reference.

When the display is illuminated so that the indicia are viewed by transmitted light, it is desirable that the intensity of illumination of the various indicia be uniform throughout the display, to minimize the visual distraction caused by "hot spots" of excessively bright indicia or "cold spots" of inadequately illuminated indicia. Because the display is illuminated by a number of lamps which provide uneven illumination due to their discrete nature and placement in recesses in the back surface of the panel, and because any cutouts present also affect the intensity of light transmitted from the lamps throughout the panel, it is necessary to somehow even the intensity of illumination over the indicia. In addition, it is desirable that the intensity of illumination of the indicia be uniform from one display to another. This evening of the illumination intensity, or "balancing" of the display panel substrate, is typically achieved by varying the thickness (and hence the transmissivity) of the diffuse translucent layer on the front of the panel substrate; with the layer typically being thicker immediately above each lamp and thinner remote from the lamps. Once the substrate is balanced, the front surface is then overcoated with an opaque layer, and the underlying translucent layer exposed in a pattern defining the indicia desired in the display, thereby completing manufacture of the display panel.

The accepted manufacturing practice for balancing display panel substrates of the type described above is both labor-intensive and craft-sensitive. Once the substrate has been coated on the back and side surfaces and recesses drilled for the lamps, the display is partially assembled so that it can be illuminated by the lamps (which are typically mounted on a circuit board behind the display panel). Working under low ambient light conditions, a skilled operator energizes the lamps to illuminate the display, then applies a diffuse translucent layer to the front surface of the substrate by spray painting. Typically, the operator first sprays paint on the front surface immediately above the lamp recesses; a process referred to as "spotting". After the spotting of the lamps is completed, the operator then sprays the remaining front surface of the substrate to achieve an even illumination of the desired intensity. Because of the low ambient light, the operator cannot see the paint as it is being applied, but must judge the effect of his actions by the appearance of the panel as coated with still-wet paint. Once the operator feels that the front surface of the substrate has been coated with the translucent layer to achieve the desired brightness and evenness of illumination, the painted panel is cured in an oven, and the brightness of the display is then measured using a photometer. If the display is too bright at any point, the painting process is repeated; if the display is not bright enough, the translucent layer must be decreased in thickness. Because the paint used for the translucent layer is formulated to possess a very high resistance to surface abrasion, sanding the translucent layer to thin it and achieve a greater brightness is very labor-intensive. The sanding operation, like the painting operation, must be performed in a darkened room so that changes in the brightness level can be seen, and the operation depends on the skill of the operator for its success. If the operator removes too much paint at any place on the front surface, that place must again be repainted and the paint once more cured before balancing can be reattempted. As can be seen from this description, balancing of illuminated display panel substrates by the method presently known to the art requires operators skilled in painting, sanding, and photometry; the working conditions of painting, dust from sanding, and low light make the task difficult to perform on a regular basis; and the cost per panel is high.

There is therefore a need for an apparatus and method for the balancing of illuminated display panels that will minimize the need for skilled labor and reduce the cost of balancing.

BRIEF SUMMARY OF THE INVENTION

This invention is a method of balancing a display panel substrate for a backlit illuminated display, comprising:

(a) providing a transparent display panel substrate having a front surface, a back surface, and side surfaces, the substrate being coated with a diffuse reflective layer and overcoated with an opaque layer on the back surface and side surfaces, and having recesses in the back surface to receive lamps to provide illumination to the display;

(b) coating the substrate on the front surface with a diffuse translucent layer of defined thickness;

(c) illuminating the substrate by lamps positioned within the recesses in the back surface of the substrate;

(d) forming an image indicative of the brightness at each point of the front surface of the illuminated substrate and determining from the image the additional thickness of diffuse translucent layer to be added to each point on the front surface of the substrate to produce a uniform brightness of a desired intensity at each point of the front surface when that layer is added and the substrate is illuminated; and (e) adding to each point on the front surface of the substrate a diffuse translucent layer of a thickness determined for that point in accordance with step (d) above.

BRIEF DESCRIPTION OF THE DRAWINGS

FIG. 4 is a flow chart illustrating the method of this invention, while

DETAILED DESCRIPTION OF THE INVENTION

"Balancing" is the process of preparing a display panel substrate possessing the desired characteristic of uniform brightness when used to form a display panel in a backlit illuminated display. "Balancing" encompasses both achieving a uniform intensity of illumination over the front surface of the substrate (and hence of the various indicia in a display containing a display panel prepared from that substrate when the display is illuminated) and achieving uniform intensity of illumination from one substrate to another (and hence of the indicia from one display to another).

"Optional" and "optionally" mean that the subsequently described event or circumstance may or may not occur, and that the description includes instances where the event or circumstance occurs and instances in which it does not. For example, "optionally overcoating the diffuse translucent layer with a clear layer" indicates that the clear layer overcoating so described may or may not be performed, and that the balancing process described includes instances in which the clear layer overcoating is performed and instances in which it is not.

Figure 1:
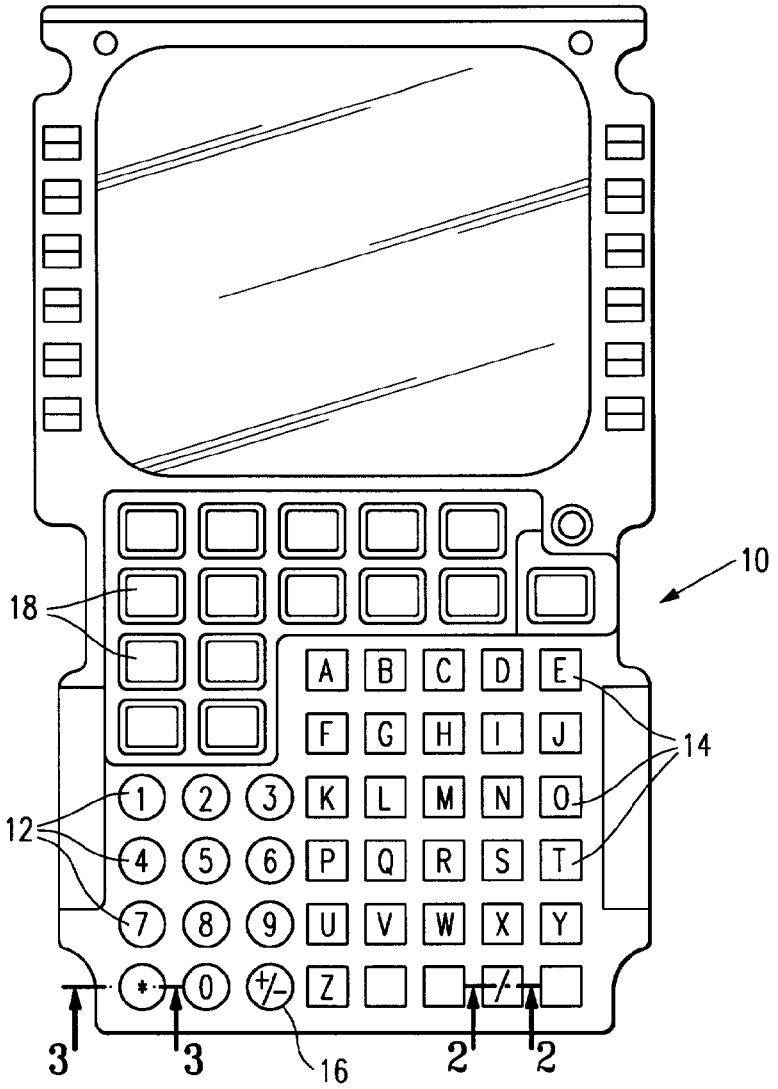
FIG. 1 is a front view of an exemplary backlit illuminated display.

Referring to the drawings, FIG. 1 is a front view of an exemplary backlit illuminated display 10 made in accordance with the method of this invention. As shown, the display 10 includes various indicia, such as numerals 12, letters 14, and other indicia such as the "+/−" symbol 16. In high ambient light conditions, such as under daylight or bright external illumination, the indicia are typically visible to a user by reflected light without self illumination of the display 10. However, under low ambient light conditions, light sources disposed behind or recessed into the back surface of the display panel are activated so that the indicia 12, 14, and 16 are self illuminated by light projecting through the indicia. The display may also contain function keys 18 projecting through cutouts in the display panel, and may additionally contain clear region 20 through which a further display, such as a cathode ray tube, may be viewed. While these cutouts and clear region are shown in this example as being generally remote from the indicia (i.e. there are not further indicia surrounding the cutouts or clear region), it is of course possible that such cutouts and clear region(s) may be interspersed with indicia in the display.

Figure 2:
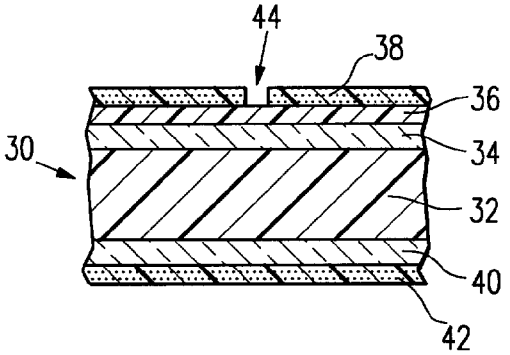
FIG. 2 is a partial sectional view of the various diffuse translucent, clear, and opaque layers disposed on the display panel substrate forming a portion of the illuminated display shown in FIG. 1, along the lines 2—2 shown in FIG. 1.

FIG. 2 is a partial sectional view of the display along line 2—2 of FIG. 1. The display panel 30 includes a transparent display panel substrate 32 on the front surface of which several layers are coated. These layers include a diffuse translucent layer 34 coated directly onto the front surface of the substrate 32, an optional clear separation layer 36 (to facilitate laser etching of the indicia in the opaque layer, as discussed in U.S. Pat. No. 5,456,955), and an opaque layer 38. The substrate 32 is also coated on the back and side surfaces with a diffuse reflective layer 40 and an opaque layer 42, so that light escaping substrate 32 from the back surface is reflected back into the substrate or otherwise absorbed. As shown in FIG. 2, the opaque layer 38 includes an etched region 44 forming a portion of an indicium, in this case the decimal point shown in FIG. 1. The transparent display panel substrate 32 and the diffuse translucent layer 34 are selected to convey light energy from a source disposed distant from the etched region 44 of the opaque layer 38 so that, under low ambient light conditions, the indicia are self-illuminated by light transmitted through the substrate 32 and layer 34 and escaping through the etched region 44. Preferably, the colors of the diffuse translucent layer 34 and the opaque layer 38 are chosen to provide sufficient contrast that the indicia are clearly visible by reflected light under high ambient light conditions; for example, the diffuse translucent layer 34 may be white, and the opaque layer 38 be black. Each layer, including the optional clear layer 36, if present, is preferably of a flat, rather than a high gloss, finish to minimize specular reflection. The opaque layer 38 may be optionally overcoated with an additional colored layer to provide a panel of any desired color; but this optional additional layer is not shown in this or other sectional Figures. The thicknesses of the various layers in FIGS. 2, 3, and 4A through 4E, and the difference in thickness of the diffuse translucent layer 34 in FIGS. 3 and 4E, are greatly exaggerated for clarity; such layers are typically of a thickness between about 15 and about 40 microns.

Figure 3:
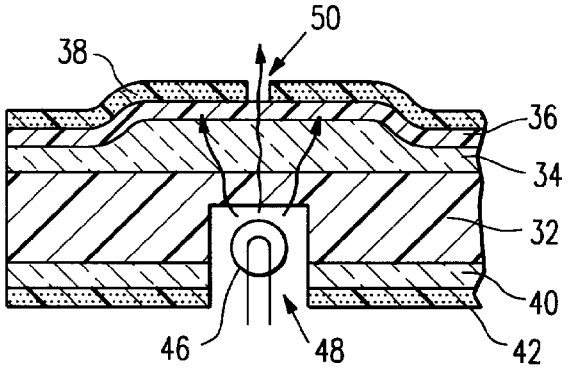
FIG. 3 is an additional partial sectional view of the various layers disposed on the display panel substrate forming a portion of the illuminated display shown in FIG. 1, along the lines 3—3 shown in FIG. 1.

FIG. 3 is a partial sectional view of the display along line 3—3 of FIG. 1. In this section, a lamp 46 is disposed in a recess 48 within the back surface of the display panel substrate 32 to provide illumination to the overlying and surrounding indicia. As discussed previously, variations in thickness of the diffuse translucent layer 34 are desired so that the intensity of illumination of indicia such as those formed by etched region 50 proximate lamp 46 and etched region 44 remote from lamp 46 are equal, thereby "balancing" the display. Thus, as shown in FIG. 3, diffuse translucent layer 34 is somewhat thicker in a region proximate the lamp 46.

Figure 4:
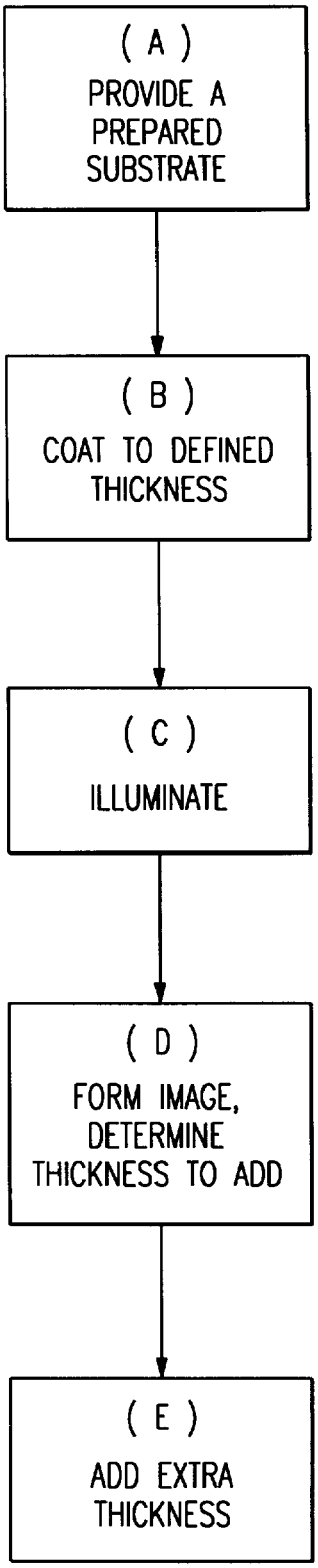
Figure 4A:
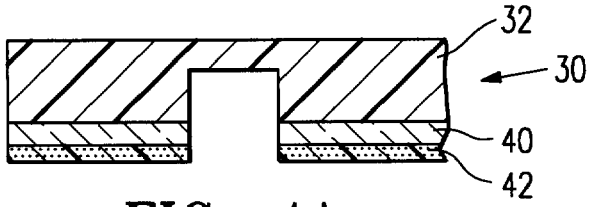
FIGS. 4A through 4E are partial sectional views of a display panel, illustrating the result of the steps shown in FIG. 4.
Figure 4B:
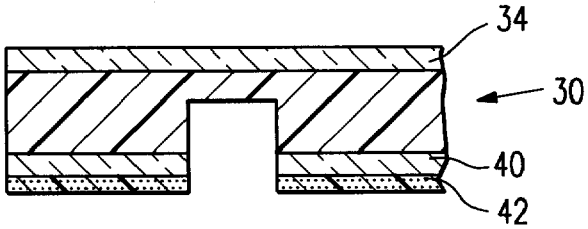
Figure 4C:
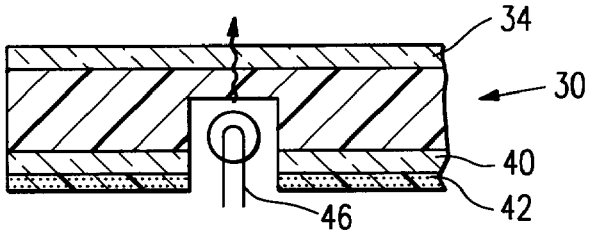
Figure 4D:
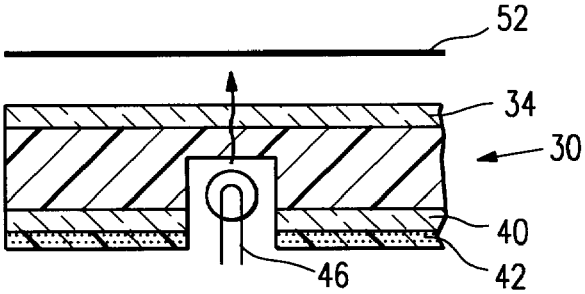
Figure 4E:
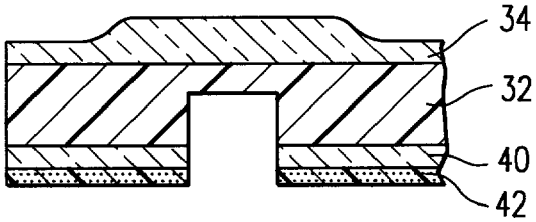

FIG. 4 shows the method of this invention for balancing a display panel substrate, and FIGS. 4A through 4E are partial sectional views of a display panel, illustrating the result of the steps shown in FIG. 4. The reference numerals used in FIGS. 4A through 4E are the same as those used in FIGS. 1 through 3 for simplicity of explanation, though FIGS. 4A through 4E do not represent any particular portion of the display shown in FIGS. 1 through 3.

In step (a), FIG. 4A, there is provided a display panel substrate 32 having the back and side surfaces coated with a diffuser reflective layer 40 and an opaque layer 42, and provided with a recess 48 to receive a lamp. Display panel substrates thus coated, with appropriate cutouts, clear areas, and recesses, may be prepared by methods conventional in the display panel art.

In step (b), FIG. 4B, the front surface of the substrate 32 is coated with a diffuse translucent layer 34 of a defined thickness.

In step (c), FIG. 4C, the substrate is partially assembled with light sources similar to those that will comprise the completed display, and the light sources energized to illuminate the substrate. As shown in FIG. 4C, lamp 46 is mounted within recess 48 and energized. Typically, a substrate will have a number of recesses 48, and a corresponding number of lamps 46 will be positioned on a printed circuit board that will be mounted behind the display panel in the completed display, but only one such recess and lamp are shown here for simplicity.

In step (d), FIG. 4D, an image indicative of the brightness at each point of the front surface of the illuminated substrate is formed, such as by making a contact image of the front surface of the illuminated substrate on photosensitive material, and from that image there is determined the additional thickness of the diffuse translucent layer 34 to be added to each point on the front surface of the substrate to produce a uniform brightness of the desired intensity at each point of the front surface when that layer is added and the substrate is illuminated.

In step (e), FIG. 4E, there is added to each point on the front surface of the substrate a diffuse translucent layer of a thickness determined for that point in accordance with step (d) above; thereby balancing the display panel substrate.

In additional steps, not shown, the balanced display panel substrate is optionally further coated on the front surface with an additional uniform diffuse translucent layer, optionally coated with a clear layer 36, coated with an opaque layer 38, and the diffuse translucent layer 34 is exposed in a pattern defining the desired indicia, thereby forming the display panel. These additional steps are conventional in the display panel art.

As can be seen from this description, the difference between the prior art balancing method and the method of this invention lies in steps (b), (c), (d), and (e) of the method, i.e. coating the substrate on the front surface with a diffuse translucent layer of defined thickness; illuminating the substrate by lamps positioned within the recesses in the back surface of the substrate; forming an image indicative of the brightness at each point of the front surface of the illuminated substrate and determining from the image the additional thickness of diffuse translucent layer to be added to each point on the front surface of the substrate to produce a uniform brightness of a desired intensity at each point of the front surface when that layer is added and the substrate is illuminated; and adding to each point on the front surface of the substrate a diffuse translucent layer of a thickness determined for that point in accordance with the previous step; and these steps will now be described in greater detail.

In step (b), layer 34, typically of a heat-curable flat white paint, may be applied by any method capable of providing a layer of the defined thickness, preferably by automated spray painting. It is important that the transmissivity of the initial defined diffuse translucent layer 34 be such that some evening of the light distribution throughout the display panel when the display is illuminated take place; and the transmissivity of the defined layer at any point should exceed the maximum transmissivity finally desired in layer 34 at that point when the display panel substrate is balanced, so that pointwise removal of layer 34 during balancing is unnecessary (thus avoiding the labor-intensive sanding steps of the prior art process). While the defined layer transmissivity at any point may be as low as the desired final transmissivity at that point, the defined layer transmissivity is preferably somewhat higher than the desired final transmissivity to allow for easier balancing. Typically, the defined layer transmissivity will be between about 50% and about 80%, preferably between about 60% and about 80%. For a typical paint of the type used in displays, this will result in a coating thickness between about 15 and 40 microns, preferably about 25 microns. The coating thickness for a given desired transmissivity may be adjusted by diluting the paint forming the diffuse translucent layer with a clear paint diluent. The layer is then dried or heat-cured as appropriate to the layer material.

In one embodiment, the defined thickness is uniform. This embodiment is simple, and is generally preferred, because application requires no particular control other than uniformity. Thus, a technique such as automated spray painting is readily applicable to this embodiment. In this embodiment, while the defined layer transmissivity may be as low as the maximum desired final transmissivity (the maximum transmissivity at any point on the balanced substrate), the defined layer transmissivity is preferably somewhat higher than the maximum desired final transmissivity to allow for easier balancing. All of the balancing of the display substrate is then performed in the later steps. In an alternative embodiment, the defined layer is nonuniform, such as by being thicker (of lower transmissivity) in regions opposite the lamp recesses. This embodiment is more complex, because it requires both some knowledge of the desired nonuniformity of application (in effect, some knowledge of the final desired thickness of the diffuse translucent layer in a balanced substrate) so that the defined thickness at any point produced in this step is never greater than the finally desired thickness at that point, and a means for achieving that desired nonuniformity of application (such as by screen printing with an screen giving greater thickness of application at locations opposite the lamp recesses or by automated spray painting in a nonuniform pattern, comparable to the "spotting" of the lamps in the prior art method). In this embodiment, although the coating step (b) is more complex, the display substrate may be partially balanced by the coating step (b), and the subsequent balancing steps may therefore be somewhat simplified.

In step (c), the substrate is partially assembled with light sources similar to those that will comprise the completed display, and the light sources energized to illuminate the substrate. This step of partial assembly and illumination is conventional.

In step (d), an image is formed indicative of the brightness of each point of the front surface of the illuminated substrate. From that image, there is determined the additional thickness of diffuse translucent layer to be added to each point on the front surface of the substrate necessary to balance the substrate. Finally, in step (e), that additional thickness of the diffuse translucent layer is added to the front surface of the substrate.

These steps (d) and (e) may be performed by various methods, of which three are set forth below.

(1) Photographic/screen printing method

A sheet of photosensitive material (photographic film or printing paper of an appropriate contrast sensitivity) is placed on the front surface of the substrate and the lamps energized for a prescribed time sufficient to form an image of the illuminated front surface on the photosensitive material. The photosensitive material is developed in the conventional manner to fix the image in the material; this image will be a negative grayscale image of the illuminated front surface. A halftone printing screen is formed from that negative gray scale image, for example by photographic and printing processes such as are conventionally used for the reproduction of photographs by printing, such that the openings in the halftone screen correspond to the bright areas in the image. The halftone screen is then used to print a further thickness of the diffuse translucent layer onto the substrate using conventional screen printing techniques. In one embodiment of this method, the gray scale image is scanned into a computer as a graphics file, and the resulting file output as a halftone image onto bond paper using a laser printer. The laser printed halftone image is photographed, and the photographic film is then used to create a halftone screen.

In this method, both the substep of forming the image indicative of the brightness at each point of the front surface of the illuminated substrate and the substep of determining the additional thickness of diffuse translucent layer to be added are photographic (i.e. the brightness of the front surface of the illuminated substrate at a point is converted into the extent of open area in the halftone screen at a position on that screen corresponding to the point imaged by photographic techniques), and the step of addition of the diffuse translucent layer is performed by screen printing.

(2) Photographic/computer-controlled printing method

A photographic negative gray scale image is produced as described above, and scanned into a computer as a graphics file (containing brightness information for each point scanned). A printer file is created from the graphics file by determining a value representing the desired thickness of translucent layer at each point from the brightness value at that point. This desired thickness value at each point may simply correspond directly to the brightness value in the graphics file for that point, or may be some function of the brightness value: it will be evident that the greater the brightness of the image of the illuminated substrate at a particular point, the greater the thickness of diffuse translucent layer required to be added to achieve uniform illumination, and the choice of an optimal function to convert brightness to layer thickness to be added will be within the skill of a person of ordinary skill in the art having regard to that knowledge and this disclosure. This printer file is then output directly to a device that applies the material of the diffuse translucent layer, such as a modified ink-jet printer capable of printing onto a flat substrate, and the material applied pointwise to the substrate.

In this method, the substep of forming the image indicative of the brightness at each point of the front surface of the illuminated substrate is photographic and the substep of determining the additional thickness of diffuse translucent layer to be added is computational, and the step of addition of the diffuse translucent layer is performed by a computer graphics output method such as ink-jet printing.

(3) Fully computer-controlled printing method

The illuminated substrate is imaged onto a photodetector connected to a computer, and a graphics file generated directly from the photo detected image. The photodetector may be a large area detector, so that the whole illuminated substrate is simultaneously imaged (using a detector comparable to the charge-coupled device detectors used in "electronic camera" and television cameras), or may be a point detector, where the image is developed pointwise by scanning onto the detector. A printer file is created from the graphics file and output directly to a device that applies the translucent layer material to the desired thickness, as described in the previous paragraph.

Suitable cameras and computer programs for this method are commercially available, and an example is the IQCam® Image Analysis System available from BWTA Ltd., Manotick, Ontario, Canada. The IQCam system is a digital photometric camera interfaced to a computer through a high-speed interface so that the camera is controlled by the computer and the resulting images are stored and manipulated by the Image Analysis System software.

In this method, the substep of forming the image indicative of the brightness at each point of the front surface of the illuminated substrate is photo detection and the substep of determining the additional thickness of diffuse translucent layer to be added is computational (as in the previous method), and the step of addition of the diffuse translucent layer is performed by a computer graphics output method such as ink-jet printing.

While the present invention has been described with reference to these specific embodiments, it will be within the skill of one of ordinary skill in the art to substitute equivalent techniques or materials for those described here without departing from the invention; and all such equivalents are intended to be within the scope of the claims.

What is claimed is:

1. A method of balancing a display panel substrate for a backlit illuminated display, comprising: (a) providing a transparent display panel substrate having a front surface, a back surface, and side surfaces, the substrate being coated with a diffuse reflective layer and overcoated with an—opaque layer on the back surface and side surfaces, and having recesses in the back surface to receive lamps to provide illumination to the display; (b) coating the substrate on the front surface with a diffuse translucent layer of defined thickness; (c) illuminating the substrate by lamps positioned within the recesses in the back surface of the substrate; (d) forming an image indicative of the brightness at each point of the front surface of the illuminated substrate and determining from the image the additional thickness of diffuse translucent layer to be added to each point on the front surface of the substrate to produce a uniform brightness of a desired intensity at each point of the front surface when that layer is added and the substrate is illuminated; and (e) adding to each point on the front surface of the substrate a diffuse translucent layer of a thickness determined for that point in accordance with step (d) above.

2. The method of claim 1 where the substep of forming an image within step (d) comprises photographing the front surface of the illuminated substrate, and developing the photograph.

3. The method of claim 2 where the photographing comprises making a contact image of the front surface of the illuminated substrate on photosensitive paper.

4. The method of claim 2 where the substep of determining the additional thickness of diffuse translucent layer within step (d) comprises preparing a printing screen having an extent of open area at a point representative of the brightness of the image of the illuminated at that point.

5. The method of claim 4 where step (e) comprises screen printing the substrate with the material of the diffuse translucent layer using the printing screen.

6. The method of claim 1 further comprising:

(f) optionally overcoating the front surface of the substrate with a clear separation layer, overcoating the front surface of the substrate with an opaque layer, and exposing the diffuse translucent layer in a pattern defining desired indicia.

7. The method of claim 6 where the optional substep of overcoating with a clear separation layer within step (f) is performed.

8. The method of claim 6 where the substep of exposing the diffuse translucent layer within step (i) is performed by etching the opaque layer with a laser.

9. The method of claim 8 where the laser is a carbon dioxide laser or a neodymium yttrium aluminum garnet laser.

10. The method of claim 7 where the substep of exposing the diffuse translucent layer within step (f) is performed by etching the opaque layer with a neodymium yttrium aluminum garnet laser.

* * * * *